US008276898B2

(12) United States Patent
Avoyan et al.

(10) Patent No.: US 8,276,898 B2
(45) Date of Patent: Oct. 2, 2012

(54) ELECTRODE TRANSPORTER AND FIXTURE SETS INCORPORATING THE SAME

(75) Inventors: Armen Avoyan, Glendale, CA (US); Hong Shih, Walnut, CA (US); Duane Outka, Freemont, CA (US)

(73) Assignee: Lam Research Corporation, Fremont, CA (US)

( * ) Notice: Subject to any disclaimer, the term of this patent is extended or adjusted under 35 U.S.C. 154(b) by 1148 days.

(21) Appl. No.: 12/136,794

(22) Filed: Jun. 11, 2008

(65) Prior Publication Data

US 2009/0311079 A1 Dec. 17, 2009

(51) Int. Cl.
*B23P 19/00* (2006.01)

(52) U.S. Cl. ..... 269/903; 269/21; 269/289 R; 29/281.1

(58) Field of Classification Search ..... 269/903, 269/900, 21, 289 R, 302.1; 29/281.1
See application file for complete search history.

(56) References Cited

U.S. PATENT DOCUMENTS 4,971,676 A * 11/1990 Doue et al. ..... 118/503
5,352,249 A * 10/1994 Vollaro ..... 29/25.01
5,842,690 A * 12/1998 Lee et al. ..... 269/21
6,012,711 A * 1/2000 Cipolla ..... 269/21
6,368,416 B1 4/2002 Wong
6,457,199 B1 10/2002 Frost et al.
6,575,444 B1 * 6/2003 Bidaud ..... 269/91
6,637,446 B2 10/2003 Frost et al.
6,995,067 B2 2/2006 Boyd et al.
7,247,579 B2 7/2007 Ren et al.
2001/0049873 A1 * 12/2001 Roovers ..... 29/740
2003/0150476 A1 8/2003 Suzuki
2005/0230892 A1 * 10/2005 Loo ..... 269/21
2008/0015132 A1 1/2008 Ren et al.
2009/0311079 A1 * 12/2009 Avoyan et al. ..... 414/222.12

* cited by examiner

*Primary Examiner* — Lee D Wilson
(74) *Attorney, Agent, or Firm* — Dinsmore & Shohl LLP

(57) ABSTRACT

An electrode transporter is provided comprising a transporter frame, a plurality of transitional support elements, and a plurality of flipside support elements. The flipside support elements are configured to immobilize an electrode along a gravitational force vector normal to a major face of an electrode positioned in an electrode accommodating space defined by the transitional support elements and the flipside support elements. The transitional support elements are configured to transition back and forth from a secured state, where the electrode is further immobilized along an opposing force vector opposite the gravitational force vector, to an unsecured state where the electrode is relatively mobile along the opposing force vector. Additional embodiments relate to the use of a transporter tripod and an electrode removal puck and lifting fork to remove an electrode from the transporter frame.

18 Claims, 5 Drawing Sheets

ELECTRODE TRANSPORTER AND FIXTURE SETS INCORPORATING THE SAME

BRIEF SUMMARY

The present invention relates to the processing of electrodes and, more particularly, to fixtures and fixture sets for handling electrodes during cleaning, treating, and other types of electrode processing operations. The concepts of the present invention are described in the context of methods for wet cleaning inner disc-shaped silicon electrodes and outer ring-shaped silicon electrodes.

According to the present invention, fixtures and fixture sets are provided that help to minimize electrode contact during processing while reducing processing time and the number of handling steps required for processing. In accordance with one embodiment of the present invention, an electrode transporter is provided comprising a transporter frame, a plurality of transitional support elements, and a plurality of flipside support elements. The flipside support elements are configured to immobilize an electrode along a gravitational force vector normal to a major face of an electrode positioned in an electrode accommodating space defined by the transitional support elements and the flipside support elements. The transitional support elements are configured to transition back and forth from a secured state, where the electrode is further immobilized along an opposing force vector opposite the gravitational force vector, to an unsecured state where the electrode is relatively mobile along the opposing force vector.

In accordance with another embodiment of the present invention, the electrode transporter is supported by a tripod that comprises a set of transporter supports that collectively define a circumferential transporter support plane. In yet another embodiment of the present invention, an electrode removal puck and a lifting fork are provided to remove an electrode from the transporter frame. Additional embodiments are disclosed and claimed.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
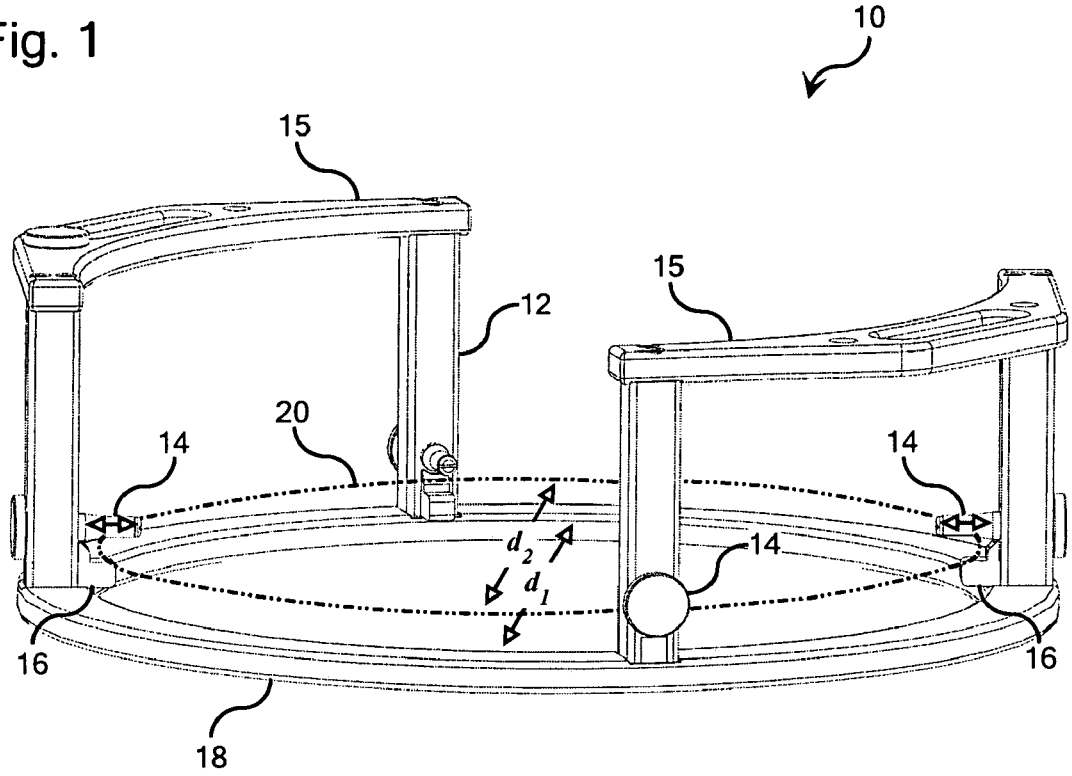
FIG. 1 illustrates an electrode transporter according to one embodiment of the present invention.
Figure 2:
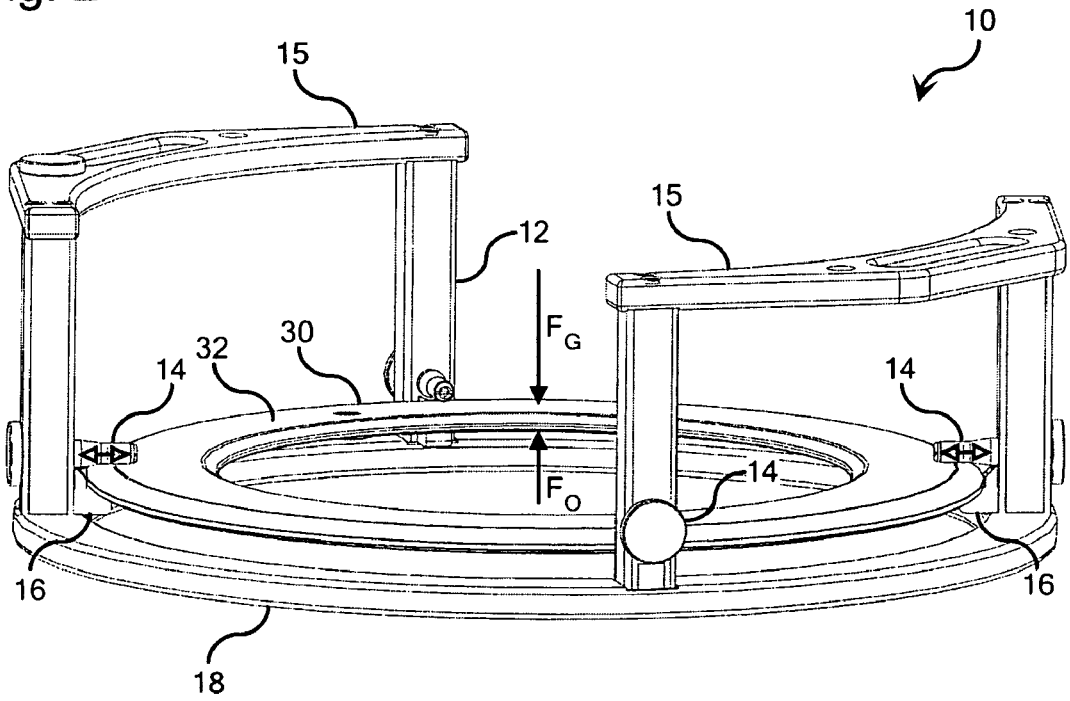
FIG. 2 illustrates the electrode transporter of FIG. 1 supporting a ring-shaped electrode.

Referring initially to FIG. 1, an electrode transporter 10 according to one embodiment of the present invention is illustrated. The electrode transporter 10 comprises a transporter frame 12, a plurality of transitional support elements 14, and a plurality of flipside support elements 16. The transitional support elements 14 and the flipside support elements 16 are coupled to the transporter frame 12 and define a circumferential electrode accommodating space 20 there between. FIG. 2 illustrates a ring-shaped outer electrode 30 positioned in the electrode accommodating space 20.

As is illustrated in FIG. 2, the flipside support elements 16 are configured to immobilize the electrode 30 along a gravitational force vector $F_G$ normal to the topside major face 32 of the electrode 30. In the secured state, which is illustrated in FIGS. 1 and 2, the transitional support elements 14 further immobilize the electrode 30 along an opposing force vector $F_O$ that is opposite the gravitational force vector $F_G$. As such, the transporter frame 10 can be inverted, i.e., turned upside-down, without dislodging the electrode 30 because the transitional support elements 14 are also configured to immobilize the electrode 30 along a gravitational force vector, while the flipside support elements 16 immobilize the electrode 30 along an opposing force vector.

In addition, as is indicated by the directional arrows in FIGS. 1 and 2, to facilitate installation and removal of the electrode 30, the transitional support elements 14 are configured to transition back and forth from a secured state, where the electrode is immobilized as is illustrated in FIG. 2, to an unsecured state where the electrode can be lifted or moved along the opposing force vector $F_G$. The transitional support elements 14 can be configured to transition to the unsecured state through retraction along a linear axis, as is illustrated in FIGS. 1, 2 and 5-8. FIGS. 5-8, which are discussed in further detail below in the context of electrode removal operations, illustrate the transitional support elements 14 in the unsecured state. Alternative configurations are contemplated where the transitional support elements 14 transition back and forth from the secured state to the unsecured state by means other than retraction along a linear axis. For example, it is contemplated that the transitional support elements 14 may pivot, flip, constrict, collapse, or otherwise transition to the unsecured state. Preferably, as is illustrated in FIGS. 5-8, the transitional support elements 14 are retracted into support element recesses defined in the transporter frame 10.

As is illustrated in FIGS. 1 and 2, the transporter frame 10 comprises a pair of handles 18 configured to facilitate transportation of the electrode transporter 10. The handles 15 are oriented to extend away from the electrode accommodating space 20, primarily in the direction of the opposing force vector $F_O$. The handles 15 extend from a substantially circumferential transporter base 18. In the illustrated embodiment, the substantially circumferential transporter base 18 and the structural majority of the pair of handles 15 define a substantially cylindrical periphery that is well-suited for dip/dunk electrode processing in a cylindrical process bath. In which case, laterally extending upper portions 17 of the handles 15 would extend above the upper bounds of the cylindrical process bath for convenient insertion and removal of the transporter frame 10 to and from the process bath.

The circumferential electrode accommodating space 20 is located in a plane displaced from the plane of the circumferential transporter base 18, between the pair of handles 15. In addition, to ensure adequate exposure of the electrode 30 to process fluids during processing, the transporter base 18 can be configured as a ring-shaped base 18 defining an open inside-base diameter $d_1$ that is aligned with, and is at least as large as, the diameter $d_2$ of the circumferential electrode accommodating space 20.

Preferably, the transitional support elements 14 and the flipside support elements 16 are either formed from a material that is softer than the material forming the electrode 30 or comprise contact pads that are formed from a material that is softer than the material forming the electrode 30. For example, in the illustrated embodiment, the transitional support elements 14 comprise rigid polymer backbones 14A formed from, e.g., PEEK, and relatively soft polymeric contact pads 14B formed from, e.g., PTFE, and positioned to be the primary points of contact with the electrode 30. The flipside support elements 16 can also be formed to comprise relatively soft polymeric contact pads or, as is illustrated in FIGS. 1 and 2, can merely be formed as a single-piece structure that is relatively rigid but still softer than the material of the electrode 30, which is typically silicon or some other conductor with or without additional electrode layers. For example, PEEK would be a suitable candidate for the single-piece flipside support elements 16. In many cases, it may also be preferable to ensure that the transitional support elements 14 and the flipside support elements 16 are formed from electrically insulating materials so as to electrically isolate an electrode 30 held in the electrode accommodating space 20.

Referring to FIGS. 9-12, it is noted that the transitional support elements 14 and the flipside support elements 16 can be provided in a variety of numbers and configurations to define the electrode accommodating space 20. For example, as is illustrated schematically in FIGS. 9 and 11, the transitional support elements 14 and the flipside support elements 16 can be positioned to directly oppose each other on opposite sides of the electrode accommodating space 20. In contrast, referring to the schematic illustrations of FIGS. 10 and 12, it is contemplated that the transitional support elements 14 and the flipside support elements 16 can be shifted relative to one another to indirectly oppose each other on opposite sides of the electrode accommodating space 20.

Figure 3:
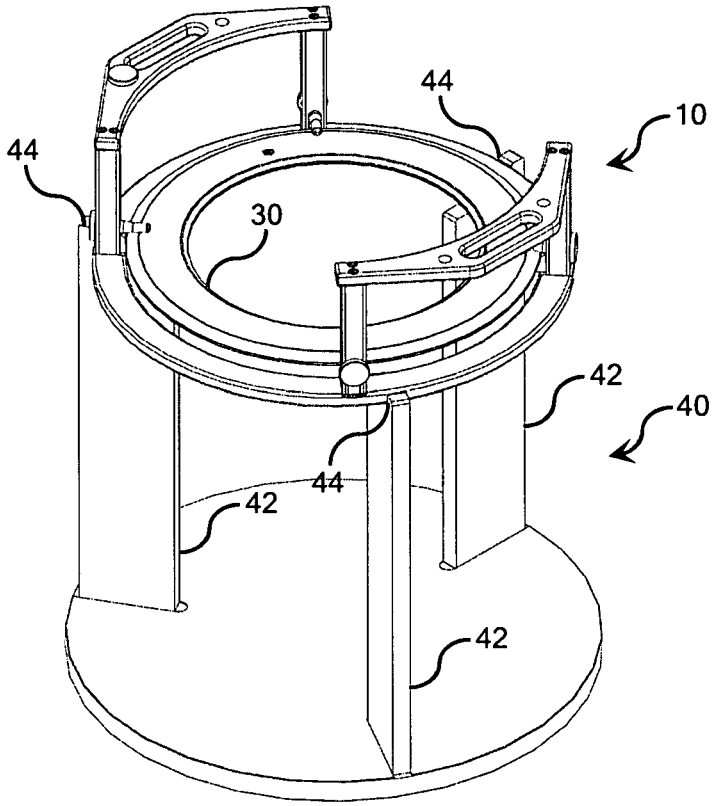
FIG. 3 illustrates the electrode transporter and ring-shaped electrode of FIG. 1 positioned atop a support tripod.
Figure 4:
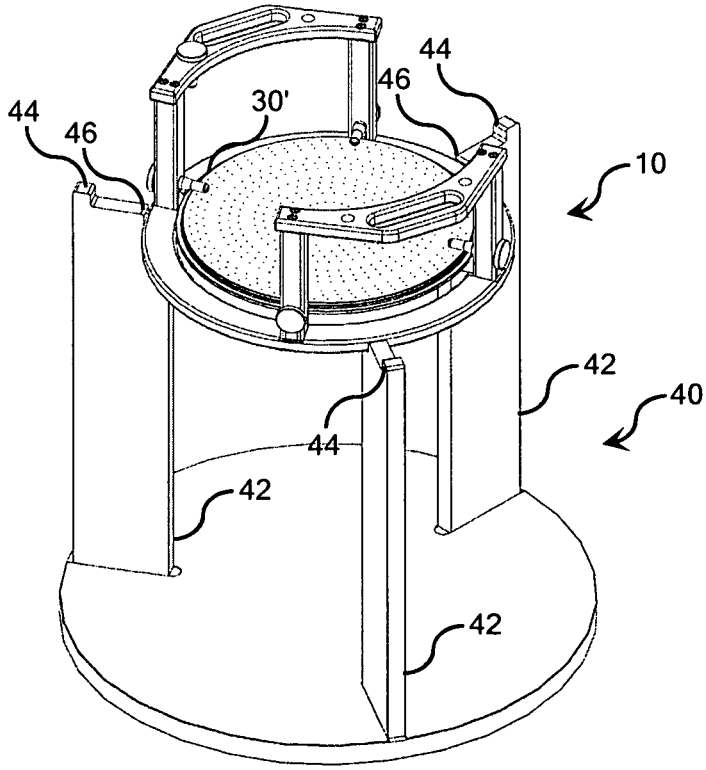
FIG. 4 illustrates an electrode transporter and disc-shaped electrode positioned atop a support tripod.
Figure 5:
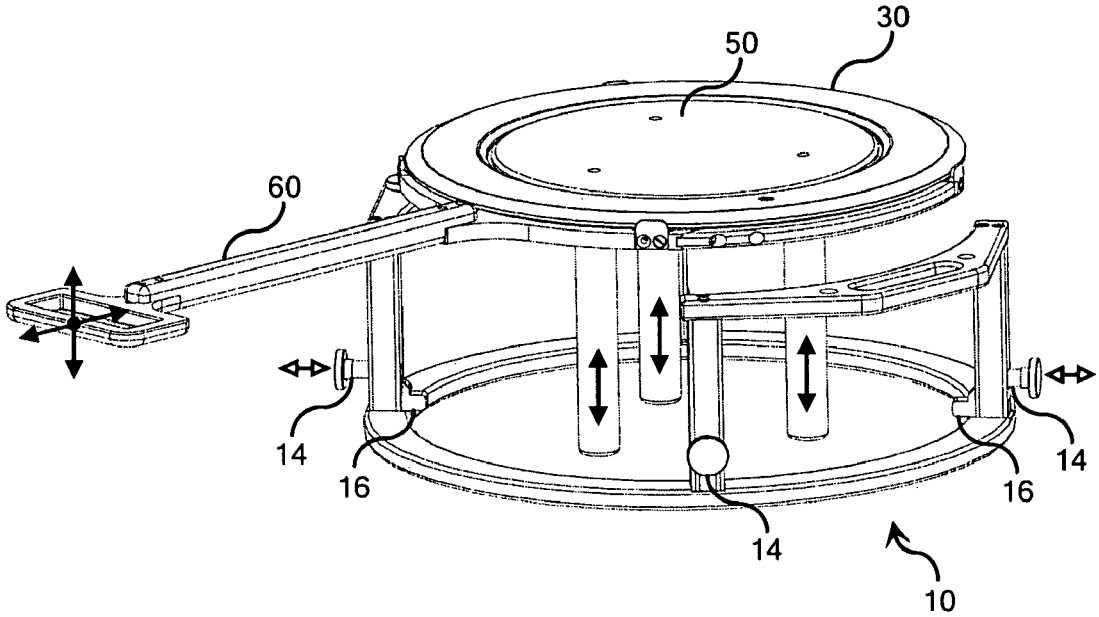
FIGS. 5 and 6 illustrate the manner in which an electrode removal puck and lifting fork can be utilized to remove an ring-shaped electrode from the electrode transporter illustrated in FIG. 1.
Figure 6:
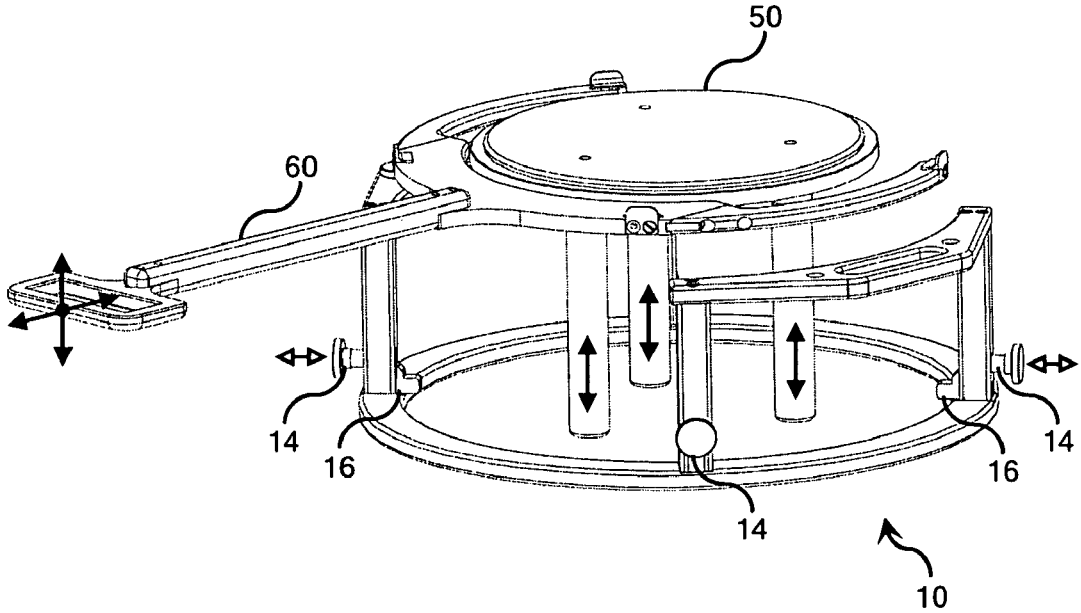
Figure 7:
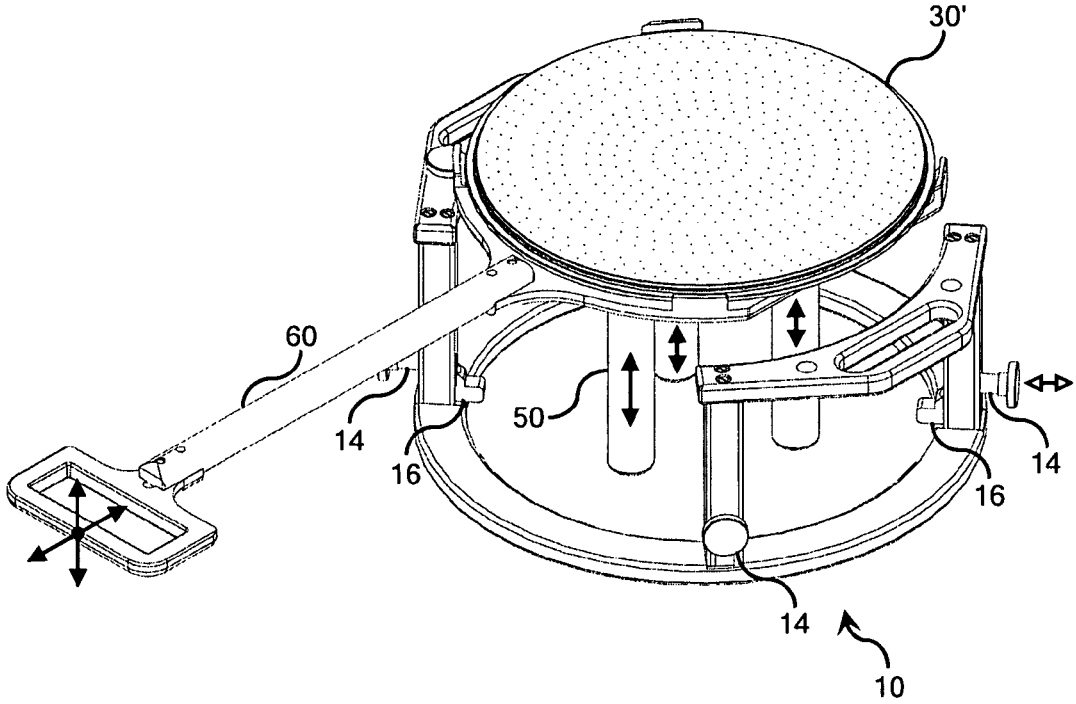
FIGS. 7 and 8 illustrate the manner in which an electrode removal puck and lifting fork can be utilized to remove a disc-shaped electrode from an electrode transporter.
Figure 8:
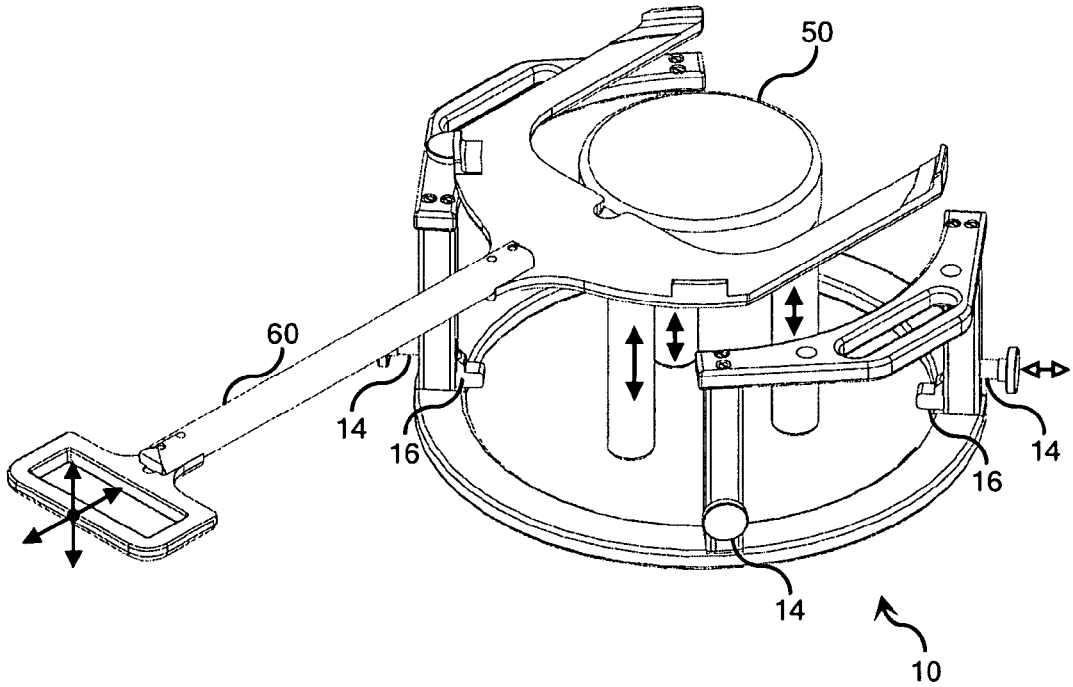
Figure 9:
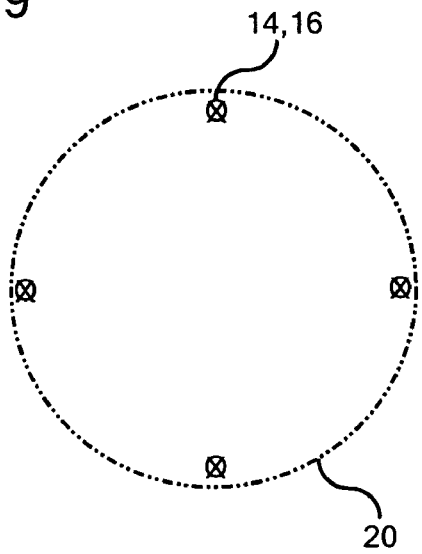
FIGS. 9-12 are schematic illustrations of some of the many suitable configurations contemplated for the transitional support elements and the flipside support elements of electrode transporters according to the present invention.
Figure 10:
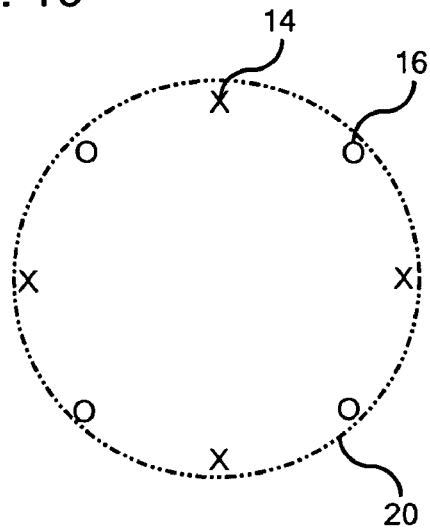
Figure 11:
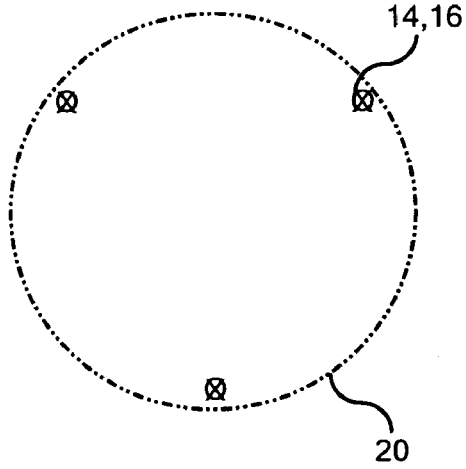
Figure 12:
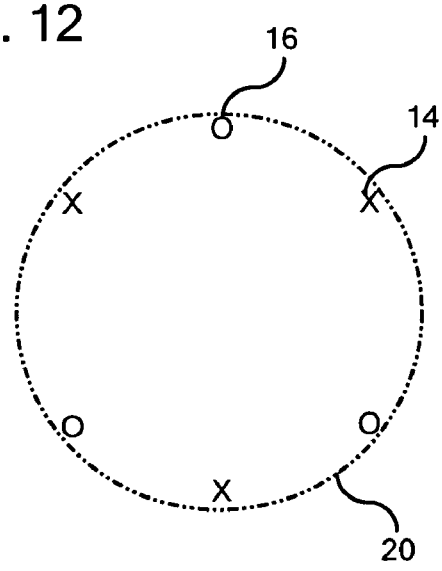

FIGS. 3 and 4 illustrate two different-sized electrode transporters 10, 10' supported by a dual-support tripod 40. The electrode transporter 10 of FIG. 3 is configured to support a ring-shaped outer electrode 30, while the electrode transporter 10' of FIG. 4 is configured to support a smaller, disc-shaped inner electrode 30'. The tripod 40 comprises a set of transporter supports 42. The upper terminals of the transporter supports comprise respective support plane hips 44, 46 which collectively define at least two distinct circumferential transporter support planes of different respective support diameters. The respective diameters of the two distinct circumferential transporter support planes, as demarcated by the respective support plane hips 44, 46, are designed to complement the corresponding diameters of the two different electrode transporters 10, 10'. In this manner, a single tripod 40 can be used to support either of the transporters 10, 10'.

FIGS. 5-8 illustrate the manner in which an electrode removal puck 50 and a lifting fork 60 can be used to remove a ring-shaped outer electrode 30 and a disc-shaped inner electrode 30' from a transporter 10, 10'. To do so, the transitional support elements 14 must be moved from the secured state illustrated in FIGS. 1 and 2, to the unsecured state illustrated in FIGS. 5-8. Once the transitional support elements 14 are clear of the electrode 30, 30', the removal puck 50 can be actuated to raise the electrode from its resting state on the flipside support elements 16 to a position above the transporter 10, where the lifting fork 60 can be used to lift the electrode 30, 30' off of the removal puck and reposition it in a new location for further processing or downstream packaging, bagging, etc. The motion of the electrode removal puck 50 and lifting fork 60 can be manual or automated and can be executed via robotics or by hand.

It is noted that recitations herein of a component of the present invention being "configured" in a particular way, to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present invention or to emphasize alternative or additional features that may or may not be utilized in a particular embodiment of the present invention.

For the purposes of describing and defining the present invention it is noted that the terms "substantially" and "approximately" are utilized herein to represent the inherent degree of uncertainty that may be attributed to any quantitative comparison, value, measurement, or other representation. For example, a substantially circumferential body need not be perfectly circumferential at every level of examination or every scale. The terms "substantially" and "approximately" are also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A device comprising an electrode transporter, the electrode transporter comprising a transporter frame, a plurality of transitional support elements, and a plurality of flipside support elements, wherein:

the transitional support elements and the flipside support elements are coupled to the transporter frame and define a circumferential electrode accommodating space between the transitional support elements and the flipside support elements;

the transporter frame comprises a substantially circumferential base and a pair of handles extending from the circumferential base;

the circumferential electrode accommodating space is located in a plane displaced from the plane of the circumferential base, between the pair of handles;

the flipside support elements are configured to immobilize an electrode along a gravitational force vector normal to a major face of an electrode positioned in the electrode accommodating space; and the transitional support elements are configured to transition back and forth from a secured state, where the electrode is further immobilized along an opposing force vector opposite the gravitational force vector, to an unsecured state where the electrode is relatively mobile along the opposing force vector.

2. A device as claimed in claim 1 wherein the transporter frame, the transitional support elements, and the flipside support elements are configured for gravitational interchange such that, when the transporter frame is inverted, the transitional support elements are configured to immobilize an electrode along the gravitational force vector and the flipside support elements are configured to further immobilize an electrode along the opposing force vector opposite the gravitational force vector.

3. A device as claimed in claim 1 wherein the transitional support elements transition to the unsecured state through retraction along a linear axis.

4. A device as claimed in claim 3 wherein the transporter frame comprises support element recesses into which the transitional support elements can be retracted.

5. A device as claimed in claim 1 wherein the transporter frame comprises a pair of handles configured for transportation of the electrode transporter, the handles being oriented to extend away from the electrode accommodating space at least partially in the direction of the opposing force vector.

6. A device as claimed in claim 5 wherein the pair of handles extend from a substantially circumferential base and the substantially circumferential base and a structural majority of the pair of handles define a substantially cylindrical periphery.

7. A device as claimed in claim 1 wherein the transporter frame comprises a substantially circumferential ring-shaped base defining an open inside-base diameter that is aligned with the circumferential electrode accommodating space.

8. A device as claimed in claim 1 wherein the transporter frame comprises a substantially circumferential ring-shaped base defining an open inside-base diameter that is at least as large as a diameter of the circumferential electrode accommodating space.

9. A device as claimed in claim 1 wherein the transporter frame comprises a substantially circumferential periphery.

10. A device as claimed in claim 1 wherein the transitional support elements and the flipside support elements comprise electrode contact pads at least partially defining bounds of the electrode accommodating space.

11. A device as claimed in claim 1 wherein the transitional support elements and the flipside support elements comprise electrically insulating electrode contact pads configured to electrically isolate an electrode held in the electrode accommodating space.

12. A device as claimed in claim 1 wherein the transitional support elements and the flipside support elements are positioned to directly or indirectly oppose each other on opposite sides of the electrode accommodating space.

13. A device as claimed in claim 1 wherein the device further comprises a tripod upon which the electrode transporter is supported, said tripod comprising a set of transporter supports that collectively define a circumferential transporter support plane.

14. A device as claimed in claim 13 wherein upper terminals of the transporter supports comprise respective support plane hips that collectively define at least two distinct circumferential transporter support planes of different respective support diameters.

15. A device as claimed in claim 14 wherein:

the device further comprises an additional electrode transporter defining a diameter distinct from the first electrode transporter; and the respective support diameters of the two distinct circumferential transporter support planes complement different ones of the electrode transporters.

16. A device as claimed in claim 1 wherein:

the device further comprises an electrode removal puck and a lifting fork;

the electrode removal puck is configured to remove an electrode from the circumferential electrode accommodating space when the transitional support elements are in the unsecured state; and the lifting fork is configured to lift an electrode supported by the electrode removal puck.

17. A device comprising an electrode transporter, the electrode transporter comprising a transporter frame, a plurality of transitional support elements, and a plurality of flipside support elements, wherein:

the transitional support elements and the flipside support elements are coupled to the transporter frame and define a circumferential electrode accommodating space between the transitional support elements and the flipside support elements;

the flipside support elements are configured to immobilize an electrode along a gravitational force vector normal to a major face of an electrode positioned in the electrode accommodating space;

the transitional support elements are configured to transition back and forth from a secured state, where the electrode is further immobilized along an opposing force vector opposite the gravitational force vector, to an unsecured state where the electrode is relatively mobile along the opposing force vector;

the transporter frame comprises support element recesses into which the transitional support elements can be retracted; and the transporter frame comprises a pair of handles configured for transportation of the electrode transporter, the handles being oriented to extend away from the electrode accommodating space at least partially in the direction of the opposing force vector.

18. A device comprising an electrode transporter, the electrode transporter comprising a transporter frame, a plurality of transitional support elements, and a plurality of flipside support elements, wherein:

the transitional support elements and the flipside support elements are coupled to the transporter frame and define a circumferential electrode accommodating space between the transitional support elements and the flipside support elements;

the flipside support elements are configured to immobilize an electrode along a gravitational force vector normal to a major face of an electrode positioned in the electrode accommodating space;

the transitional support elements are configured to transition back and forth from a secured state, where the electrode is further immobilized along an opposing force vector opposite the gravitational force vector, to an unsecured state where the electrode is relatively mobile along the opposing force vector; and the device further comprises a tripod upon which the electrode transporter is supported, said tripod comprising a set of transporter supports that collectively define a circumferential transporter support plane.

* * * * *